US007628829B2

(12) United States Patent
Woo et al.

(10) Patent No.: US 7,628,829 B2
(45) Date of Patent: Dec. 8, 2009

(54) ABRASIVE ARTICLE AND METHOD OF MAKING AND USING THE SAME

(75) Inventors: Edward J. Woo, Woodbury, MN (US); Thomas W. Rambosek, Woodbury, MN (US); Seyed A. Angadjivand, Woodbury, MN (US); Mary B. Donovan, St. Paul, MN (US); Rufus C. Sanders, Jr., Burnsville, MN (US); Yeun-Jong Chou, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/688,482

(22) Filed: Mar. 20, 2007

(65) Prior Publication Data

US 2008/0229672 A1 Sep. 25, 2008

(51) Int. Cl.

| | |
|---|---|
| ***B24B 1/00*** | (2006.01) |
| ***B24D 11/00*** | (2006.01) |
| ***C09K 3/14*** | (2006.01) |
| ***B24D 3/02*** | (2006.01) |
| ***C09C 1/68*** | (2006.01) |

(52) U.S. Cl. ..... 51/295; 51/307; 51/308; 51/309; 51/297; 51/293; 451/526; 451/527; 451/532; 451/533; 451/536; 451/537; 451/538; 451/539

(58) Field of Classification Search ..... 51/295, 51/307–309, 297, 293; 451/526–527, 532, 451/536–539, 533

See application file for complete search history.

(56) References Cited

U.S. PATENT DOCUMENTS

| | | | |
|---|---|---|---|
| 2,123,581 | A | 7/1938 | Anderson |
| 2,740,239 | A | 4/1956 | Ball et al. |
| 2,984,052 | A | 5/1961 | Mueller, Jr. |
| 3,420,007 | A | 1/1969 | Kolesh |
| 3,426,486 | A | 2/1969 | Kubsh |
| 3,861,892 | A | 1/1975 | Wisdom, Jr. et al. |
| 3,932,966 | A | 1/1976 | Stern |
| 4,215,682 | A | 8/1980 | Kubik et al. |
| 4,282,011 | A | 8/1981 | Terpay |
| 4,287,685 | A | 9/1981 | Marton |

(Continued)

FOREIGN PATENT DOCUMENTS

| | | |
|---|---|---|
| DE | 201 11 245 U 1 | 6/2001 |

(Continued)

OTHER PUBLICATIONS

Office Action dated Dec. 17, 2008 received in copending U.S. Appl. No. 11/688,497 (Woo et al.).*

(Continued)

*Primary Examiner*—Michael A Marcheschi
*Assistant Examiner*—Pegah Parvini
(74) *Attorney, Agent, or Firm*—Bradford B. Wright

(57) ABSTRACT

An abrasive article comprises a porous abrasive member, a nonwoven filter medium, and a porous attachment fabric. A plurality of openings in the porous abrasive member cooperates with the nonwoven filter medium to allow the flow of particles from an outer abrasive surface of the porous abrasive member to the porous attachment fabric. Methods of making and using the abrasive articles are included.

14 Claims, 3 Drawing Sheets

U.S. PATENT DOCUMENTS

| | | | | |
|---|---|---|---|---|
| RE30,782 | E | 10/1981 | van Turnhout | |
| 4,374,888 | A | 2/1983 | Bornslaeger | |
| RE31,285 | E | 6/1983 | van Turnhout et al. | |
| 4,592,815 | A | 6/1986 | Nakao | |
| 4,609,581 | A | 9/1986 | Ott | |
| 4,714,644 | A | 12/1987 | Rich | |
| 4,725,487 | A | 2/1988 | Pemrick et al. | |
| 4,894,060 | A | 1/1990 | Nestegard | |
| 5,007,206 | A | 4/1991 | Paterson | |
| 5,036,627 | A | 8/1991 | Walters | |
| 5,057,710 | A | 10/1991 | Nishiura et al. | |
| 5,058,247 | A | 10/1991 | Thomas et al. | |
| 5,131,924 | A | 7/1992 | Wiand | |
| 5,254,194 | A | 10/1993 | Ott et al. | |
| 5,306,545 | A | 4/1994 | Shirayanagi et al. | |
| 5,317,886 | A | 6/1994 | Prahl | |
| 5,389,032 | A | 2/1995 | Beardsley | |
| 5,458,532 | A | 10/1995 | Cannone | |
| 5,472,481 | A | 12/1995 | Jones et al. | |
| 5,490,878 | A | 2/1996 | Peterson et al. | |
| 5,496,507 | A | 3/1996 | Angadjivand et al. | |
| 5,560,794 | A | 10/1996 | Currie et al. | |
| 5,578,343 | A | 11/1996 | Gaeta et al. | |
| 5,607,345 | A | 3/1997 | Barry et al. | |
| 5,674,122 | A | 10/1997 | Krech | |
| 5,679,302 | A | 10/1997 | Miller et al. | |
| 5,807,161 | A | 9/1998 | Manor et al. | |
| 5,810,650 | A | 9/1998 | Jöst | |
| 5,976,208 | A | 11/1999 | Rousseau et al. | |
| 5,989,112 | A | 11/1999 | Long et al. | |
| 6,024,634 | A | 2/2000 | Höglund et al. | |
| 6,074,292 | A | 6/2000 | Gilday | |
| 6,077,601 | A | 6/2000 | DeVoe et al. | |
| 6,139,308 | A | 10/2000 | Berrigan et al. | |
| 6,190,246 | B1 | 2/2001 | Parrott et al. | |
| 6,264,194 | B1 | 7/2001 | Hayashi et al. | |
| 6,482,308 | B1 | 11/2002 | Wiemann | |
| 6,575,821 | B2 | 6/2003 | Jöst | |
| 6,579,161 | B1 | 6/2003 | Chesley et al. | |
| 6,613,113 | B2 | 9/2003 | Minick et al. | |
| 6,790,126 | B2 | 9/2004 | Wood et al. | |
| 6,923,840 | B2 | 8/2005 | Schutz et al. | |
| 7,244,170 | B2 * | 7/2007 | Woo et al. | 451/527 |
| 7,252,694 | B2 | 8/2007 | Woo et al. | |
| 7,258,705 | B2 * | 8/2007 | Woo et al. | 51/298 |
| 7,329,175 | B2 | 2/2008 | Woo et al. | |
| 7,338,355 | B2 | 3/2008 | Sanders et al. | |
| 7,390,244 | B2 | 6/2008 | Woo et al. | |
| 7,393,269 | B2 | 7/2008 | Rambosek et al. | |
| 7,452,265 | B2 * | 11/2008 | Rambosek et al. | 451/530 |
| 2001/0023168 | A1 | 9/2001 | Wuensch et al. | |
| 2001/0044006 | A1 | 11/2001 | Kruegler | |
| 2002/0016144 | A1 | 2/2002 | Jost | |
| 2003/0003856 | A1 | 1/2003 | Swei | |
| 2003/0032383 | A1 | 2/2003 | Nelson et al. | |
| 2003/0087053 | A1 | 5/2003 | Fukushi | |
| 2003/0127108 | A1 | 7/2003 | Policicchio et al. | |
| 2003/0159363 | A1 | 8/2003 | Chesley et al. | |
| 2004/0098923 | A1 | 5/2004 | Hood et al. | |
| 2004/0107649 | A1 | 6/2004 | Emerson et al. | |
| 2004/0109978 | A1 | 6/2004 | Michel | |
| 2004/0148866 | A1 | 8/2004 | Krupnick | |
| 2004/0166788 | A1 | 8/2004 | Travis | |
| 2004/0170801 | A1 | 9/2004 | Seth et al. | |
| 2004/0180618 | A1 | 9/2004 | Suzuki et al. | |
| 2004/0209561 | A1 | 10/2004 | Suzuki et al. | |
| 2005/0020190 | A1 | 1/2005 | Schutz et al. | |
| 2005/0124274 | A1 | 6/2005 | Hoglund | |
| 2006/0019579 | A1 | 1/2006 | Braunschweig et al. | |
| 2006/0148390 | A1 * | 7/2006 | Woo et al. | 451/526 |
| 2006/0280908 | A1 | 12/2006 | Hoglund | |
| 2007/0028525 | A1 | 2/2007 | Woo et al. | |
| 2007/0028526 | A1 | 2/2007 | Woo et al. | |
| 2007/0066197 | A1 | 3/2007 | Woo et al. | |
| 2007/0066198 | A1 * | 3/2007 | Rambosek et al. | 451/533 |
| 2007/0066199 | A1 * | 3/2007 | Woo et al. | 451/533 |

FOREIGN PATENT DOCUMENTS

| | | | |
|---|---|---|---|
| EP | 0 244 934 | A2 | 11/1987 |
| EP | 0 535 431 | B1 | 4/1993 |
| EP | 0 738 562 | A2 | 10/1996 |
| EP | 1 448 888 | A1 | 12/2004 |
| FR | 2 739 308 | | 4/1997 |
| GB | 1137556 | | 12/1968 |
| JP | 5-220670 | | 8/1993 |
| JP | 11-179668 | | 7/1999 |
| JP | 2004-90110 | A | 3/2004 |
| WO | WO 96/07509 | A1 | 3/1996 |
| WO | WO 00/54936 | A1 | 9/2000 |
| WO | WO 03/020474 | A1 | 3/2003 |

OTHER PUBLICATIONS

Sanders et al., "Abrasive Article and Methods of Making and Using the Same", U.S. Appl. No. 11/423,829, filed Jun. 13, 2006.

Brandner et al., "Monocomponent Monolayer Meltblown Web and Meltblowing Apparatus", U.S. Appl. No. 11/461,136, filed Jul. 31, 2006.

Rambosek et al., "Abrasive Article and Methods of Making the Same", U.S. Appl. No. 11/614,431, filed Dec. 21, 2006.

Woo et al., "Abrasive Article and Method of Making and Using the Same", U.S. Appl. No. 11/688,497, filed Mar. 20, 2007.

ASTM D 5736-95, "Standard Test Method for Thickness of Highloft Nonwoven Fabrics"; Reapproved 2001.

Woo et al., "Abrasive Article and Method of Making and Using the Same", U.S. Appl. No. 11/688,497, filed Mar. 20, 2007.

Office Action dated Jun. 18, 2008 received in copending U.S. Appl. No. 11/688,497, (Woo et al.).

Office Action dated Jun. 18, 2008 received in copending U.S. Appl. No. 11/688,497 (Woo et al.).

* cited by examiner

ABRASIVE ARTICLE AND METHOD OF MAKING AND USING THE SAME

BACKGROUND

Abrasive articles are used in industry for abrading, grinding, and polishing applications. They may be obtained in a variety of converted forms, such as belts, discs, sheets, and the like, in many different sizes.

Generally, when using abrasives articles in the form of "sheet goods" (i.e., discs and sheets), a back-up pad is used to mount or attach the abrasive article to the abrading tool. One type of back-up pad has dust collection holes connected by a series of grooves. The dust collection holes are typically connected to a vacuum source to help control particles such as, for example, swarf (as used herein, the term "swarf" refers loose material such as dust and debris generated during abrading processes) build-up on the abrading surface of the abrasive article. Removing swarf from the abrading surface is known to improve the performance of the abrasive article.

Some abrasive tools have integral vacuum systems with dust collection means. The extracting and holding capabilities of these abrasive tools have been limited, in part, due to the suction requirements of current abrasive disks that their related back-up pads require.

In some abrasive tool configurations, dust is collected in a complex collection system through a hose connected to the abrasive tools. Dust collection systems, however, are not always available for the abrasive tool operator. Further, the use of dust collection systems requiring hoses may be cumbersome and may interfere with the operator's manipulation of the abrasive tool.

SUMMARY

In one aspect, the present invention provides an abrasive article comprising:

a porous abrasive member comprising: an abrasive layer proximate and affixed to a first surface of a substrate, the abrasive layer comprising a plurality of abrasive particles affixed to the first surface of the substrate by at least one binder, wherein the abrasive layer has an outer abrasive surface, wherein the substrate has a second surface opposite the first surface of the substrate, and wherein a plurality of openings extend from the outer abrasive surface to the second surface of the substrate;

a nonwoven filter medium having a first surface and a second surface opposite the first surface, wherein the first surface of the nonwoven filter medium is proximate and affixed to the second surface of the substrate, and wherein the nonwoven filter medium comprises a plurality of fibers; and a porous attachment fabric proximate and affixed to the second surface of the nonwoven filter medium;

wherein the plurality of openings cooperate with the nonwoven filter medium to allow the flow of particles from the outer abrasive surface to the porous attachment fabric, and wherein, in an unused state, the at least a portion of the abrasive article exhibits a pressure drop according to the Pressure Drop Measurement Test in a range of from 0.2 to 20 millimeters of water.

In another aspect, the present invention provides a method of making an abrasive article, the method comprising:

providing a porous abrasive member comprising: an abrasive layer proximate and affixed to a first surface of a substrate, the abrasive layer comprising a plurality of abrasive particles affixed to the first surface of the substrate by at least one binder, wherein the abrasive layer has an outer abrasive surface, wherein the substrate has a second surface opposite the first surface of the substrate, and wherein a plurality of openings extend from the outer abrasive surface to the second surface of the substrate;

providing a nonwoven filter medium, the nonwoven filter medium having a first surface and a second surface opposite the first surface, wherein the first surface of the nonwoven filter medium is proximate and affixed to the second surface of the substrate;

affixing the nonwoven filter medium to the second surface of the substrate; and affixing a porous attachment fabric to the second surface of the nonwoven filter medium;

wherein the plurality of openings cooperate with the nonwoven filter medium to allow the flow of particles from the outer abrasive surface to the porous attachment fabric, and wherein, in an unused state, at least a portion of the abrasive article exhibits a pressure drop according to the Pressure Drop Measurement Test in a range of from 0.2 to 20 millimeters of water.

In yet another aspect, the present invention provides an abrasive article comprising:

a porous abrasive member comprising: an abrasive layer proximate and affixed to a first surface of a substrate, the abrasive layer comprising a plurality of abrasive particles affixed to the first surface of the substrate by at least one binder, wherein the abrasive layer has an outer abrasive surface, wherein the substrate has a second surface opposite the first surface of the substrate, and wherein a plurality of openings extend from the outer abrasive surface to the second surface of the substrate;

a nonwoven filter medium having a first surface and a second surface opposite the first surface, wherein the first surface of the nonwoven filter medium is proximate and affixed to the second surface of the substrate, wherein the nonwoven filter medium comprises a plurality of fibers, and wherein the nonwoven filter medium has a thickness of from 1 to 25 millimeters and a bulk density of from 0.04 to 0.5 grams per cubic centimeter; and a porous attachment fabric proximate and affixed to the second surface of the nonwoven filter medium;

wherein the plurality of openings cooperate with the nonwoven filter medium to allow the flow of particles from the outer abrasive surface to the porous attachment fabric.

In yet another aspect the present invention provides a method of making an abrasive article, the method comprising:

providing a porous abrasive member comprising: an abrasive layer proximate and affixed to a first surface of a substrate, the abrasive layer comprising a plurality of abrasive particles affixed to the first surface of the substrate by at least one binder, wherein the abrasive layer has an outer abrasive surface, wherein the substrate has a second surface opposite the first surface of the substrate, and wherein a plurality of openings extend from the outer abrasive surface to the second surface of the substrate;

providing a nonwoven filter medium having a first surface and a second surface opposite the first surface, wherein the first surface of the nonwoven filter medium is proximate the second surface of the substrate, wherein the second nonwoven filter medium has a thickness of from 0.5 to 15 millimeters and a bulk density of from 0.04 to 0.5 grams per cubic centimeter;

affixing the nonwoven filter medium to the second surface of the substrate; and affixing a porous attachment fabric to the second surface of the nonwoven filter medium;

wherein the plurality of openings cooperate with the nonwoven filter medium to allow the flow of particles from the outer abrasive surface to the porous attachment fabric.

In certain embodiments, the porous abrasive member comprises an apertured coated abrasive. In certain embodiments, the porous abrasive member comprises a screen abrasive. In certain embodiments, the porous attachment fabric comprises a loop portion or a hook portion of a two-part mechanical engagement system. In certain embodiments, the nonwoven filter medium and the porous attachment fabric are affixed to one another by needletacking or a stitch bond. In certain embodiments, the porous abrasive member is affixed to the nonwoven filter medium by an adhesive. In certain embodiments, the nonwoven filter medium is affixed to the porous attachment fabric by an adhesive. In certain embodiments, the nonwoven filter medium has a peripheral edge, and the peripheral edge is sealed. In certain embodiments, the nonwoven filter medium comprises synthetic fibers selected from the group consisting of polypropylene fibers, polyester fibers, nylon fibers, and mixtures thereof. In certain embodiments, the nonwoven filter medium comprises a blown microfiber web. In certain embodiments, the nonwoven filter medium comprises an electret charge.

In certain embodiments, the second surface of the substrate and the first surface of the nonwoven filter medium are coextensive. In certain embodiments, the substrate is selected from the group consisting of metal foil, paper, fabric, and plastic film. In certain embodiments, the abrasive article comprises an abrasive disc.

In certain embodiments, a porous attachment fabric is affixed to the nonwoven filter medium. In certain embodiments, the porous attachment fabric comprises a loop portion or a hook portion of a two-part mechanical engagement system. In certain embodiments, the nonwoven filter medium and the porous attachment fabric are affixed to one another by needletacking or a stitch bond.

Abrasive articles according to the present invention are useful, for example, for abrading a surface of a workpiece by a method comprising contacting the surface with the abrasive article, and relatively moving the abrasive article and the surface to mechanically modify the surface.

Advantageously, abrasive articles according to the present invention are particularly suitable for use in those abrading applications generating appreciable amounts of particles (e.g., swarf), and in at least some embodiments, may effectively trap at least 40, 50 (i.e., a majority), 60, 70, 80, or even more than 90 percent of particles generated in such abrading applications, for example, if used in combination with a tool having a vacuum source.

As used herein, the term "air resistance" refers to resistance of air passing through the thickness dimension of a nonwoven web or abrasive article, and, when used for comparison purposes, all air resistance values are to be measured under like conditions;

the term "fabric" includes woven and knit materials, but excludes materials that are non-woven.

the term "nonwoven filter medium" refers to a material, having internal void space and formed substantially of a plurality of entangled and/or bonded fibers, produced by a process other than weaving or knitting; and the term "thickness" as applied to a nonwoven filter medium refers to the thickness of the nonwoven web as measured according to ASTM D5736-95 (Reapproved 2001) "Standard Test Method for Thickness of Highloft Nonwoven Fabrics" using a pressure plate force of 0.002 pound per square inch (13.8 Pa).

These figures, which are idealized, are intended to be merely illustrative of the abrasive article of the present invention and non-limiting.

DETAILED DESCRIPTION

Figure 1A:
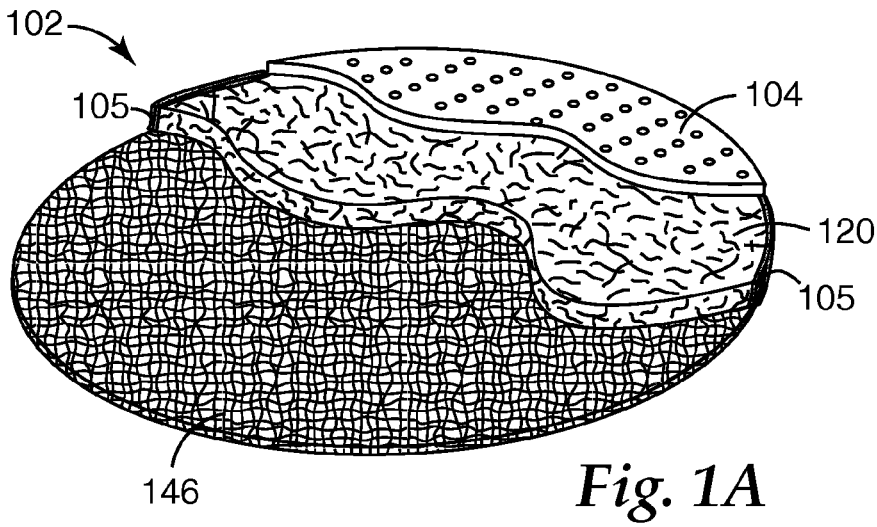
FIG. 1A is a perspective view of an exemplary abrasive article according to one embodiment of the present invention, partially cut away to reveal the layers forming the article.

FIG. 1A shows a perspective view of an exemplary abrasive article 102 (shown as an abrasive disc) with a partial cutaway. As shown in FIG. 1A, the abrasive article 102 has a porous abrasive member 104, a nonwoven filter medium 120 and a porous attachment fabric 146. The porous abrasive member 104 comprises a plurality of openings that allow the flow of particles (e.g., swarf generated during an abrading process) through the porous abrasive member 104. Particles are then captured by the filter medium within the abrasive article. Optional seal 105 seals the peripheral edge 106 (shown in FIG. 1B) of nonwoven filter medium 120 thereby preventing lateral escape of particles not retained by the abrasive article.

Figure 1B:
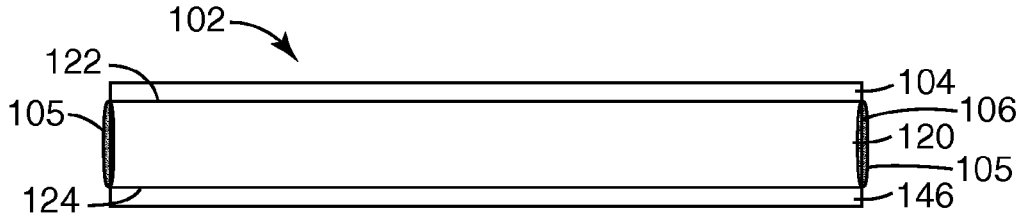
FIG. 1B is a schematic cross-sectional view of the abrasive article shown in FIG. 1A.

FIG. 1B shows a schematic cross-sectional view of the abrasive article 102 shown in FIG. 1A. As shown in FIG. 1B, the abrasive article 102 comprises multiple layers. The nonwoven filter medium 120 comprises a first surface 122 and a second surface 124 opposite the first surface 122. The first surface 122 of the nonwoven filter medium 120 is proximate the porous abrasive member 104. The second surface 124 of the nonwoven filter medium 120 is proximate the porous attachment fabric 146.

Figure 2A:
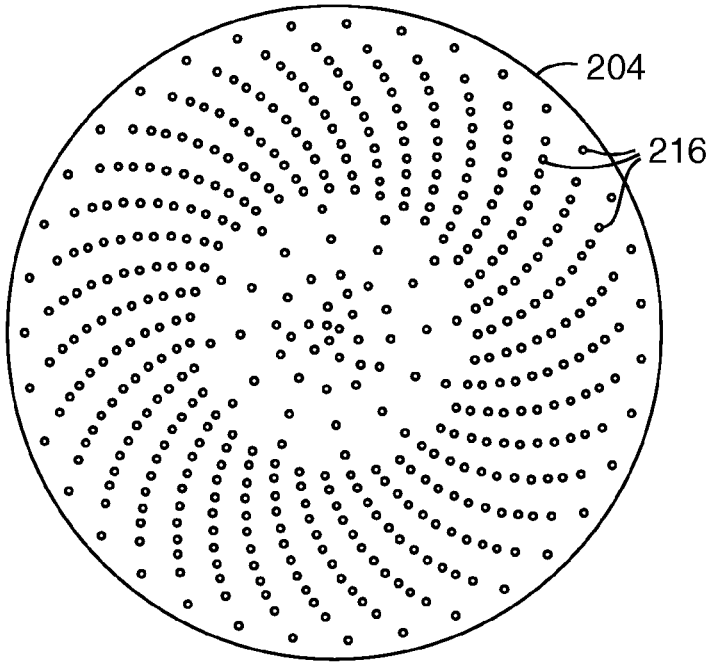
FIG. 2A is a top view of an exemplary porous abrasive member useful in abrasive articles according to the present invention.
Figure 2B:
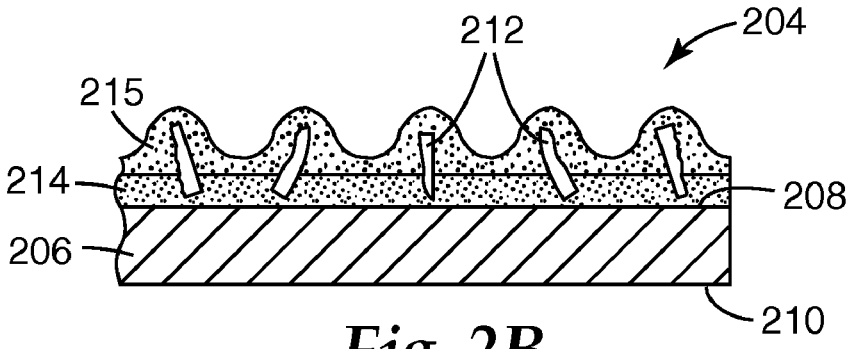
FIG. 2B is a cross-sectional view of the porous abrasive member shown in FIG. 2A.

FIG. 2A shows a top view of an exemplary coated abrasive material used to form the porous abrasive member. FIG. 2B shows a cross-sectional view of a section of the porous abrasive member shown in FIG. 2A. As shown in FIG. 2B, the porous abrasive member 204 comprises a substrate 206 having a first surface 208 and a second surface 210, a make coat 214, a plurality of abrasive particles 212, and a size coat 215. As shown in FIG. 2A, the porous abrasive member 204 comprises a plurality of apertures 216 (not shown in FIG. 2B).

Figure 3:
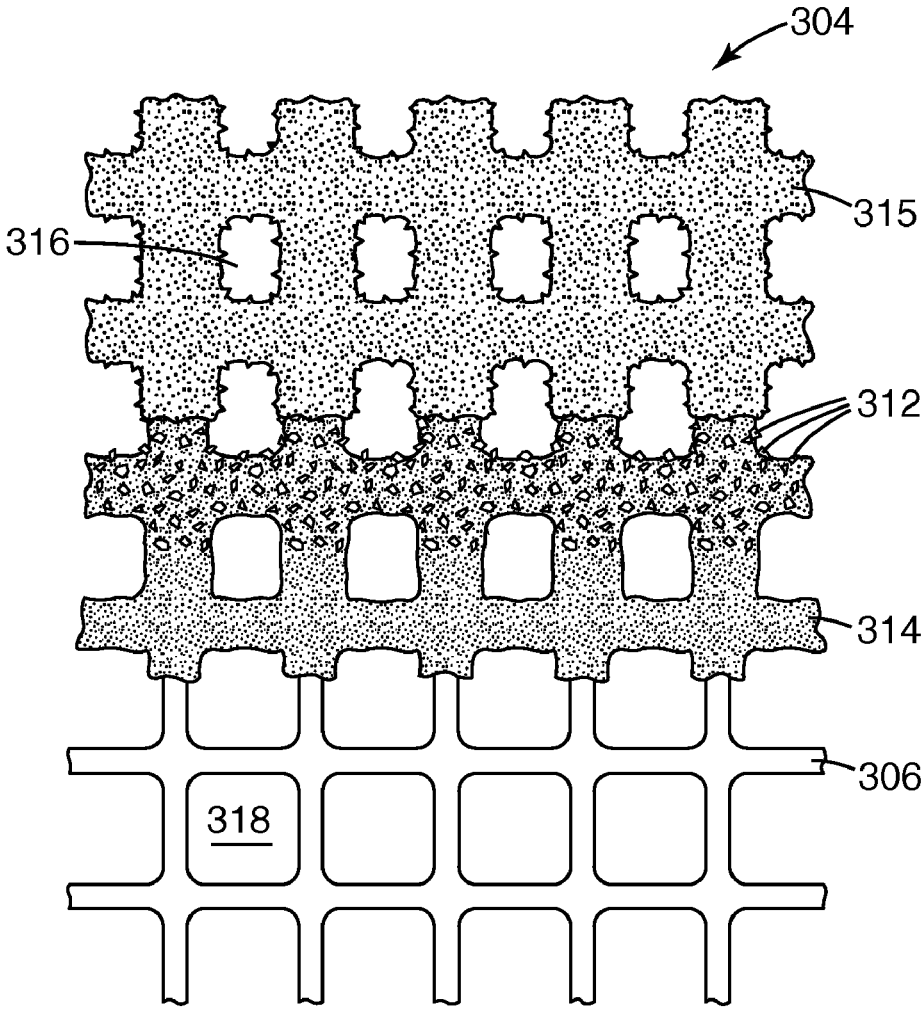
FIG. 3 is a top view of an exemplary porous abrasive member useful in abrasive articles according to the present invention, partially cut away to reveal the components forming the abrasive layer.

FIG. 3 shows a top view of an exemplary screen abrasive material used to form the porous abrasive member. FIG. 3 includes a partial cutaway to reveal the components forming the abrasive layer. As shown in FIG. 3, the porous abrasive member 304 comprises an open mesh substrate 306, a make coat 314, a plurality of abrasive particles 312, and a size coat 315. The porous abrasive member 304 comprises a plurality of openings 316 that extend through the porous abrasive member. The openings 316 are formed by openings 318 in the open mesh substrate 306.

The open mesh substrate may be made from any porous material including, for example, perforated films, nonwovens, or woven or knitted fabrics. In the embodiment shown in FIG. 3, the open mesh substrate 306 is a perforated film. The film for the substrate may be made from metal, paper, or plastic, including molded thermoplastic materials and molded thermoset materials. In some embodiments, the open mesh substrate comprises perforated or slit and stretched sheet materials. In some embodiments, the open mesh substrate comprises fiberglass, nylon, polyester, polypropylene, or aluminum.

The openings 318 in the open mesh substrate 306 may be generally square shaped as shown in FIG. 3. In other embodiments, the shape of the openings may be other geometric shapes including, for example, a rectangular shape, a circular shape, an oval shape, a triangular shape, a parallelogram shape, a polygon shape, or a combination of these shapes. The openings 318 in the open mesh substrate 306 may be uniformly sized and positioned as shown in FIG. 3. In other embodiments, the openings may be placed non-uniformly by, for example, using a random opening placement pattern, varying the size or shape of the openings, or any combination of random placement, random shapes, and random sizes.

In another aspect, a screen abrasive with a woven or knitted substrate may be used to form the porous abrasive member. A woven substrate typically comprises a plurality of generally parallel warp elements that extend in a first direction and a plurality of generally parallel weft elements that extend in a second direction. The weft elements and warp elements of the open mesh substrate intersect to form a plurality of openings. The second direction may be perpendicular to the first direction to form square shaped openings in the woven open mesh substrate. In some embodiments, the first and second directions intersect to form a diamond pattern. The shape of the openings may be other geometric shapes including, for example, a rectangular shape, a circular shape, an oval shape, a triangular shape, a parallelogram shape, a polygon shape, or a combination of these shapes. In some embodiments, the warp and weft elements are yarns that are woven together in a one-over-one weave.

The warp and weft elements may be combined in any manner known to those in the art including, for example, weaving, stitch-bonding, or adhesive bonding. The warp and weft elements may be fibers, filaments, threads, yarns or a combination thereof. The warp and weft elements may be made from a variety of materials known to those skilled in the art including, for example, synthetic fibers, natural fibers, glass fibers, and metal. In some embodiments, the warp and weft elements comprise monofilaments of thermoplastic material or metal wire. In some embodiments, the woven open mesh substrate comprises nylon, polyester, or polypropylene.

The porous abrasive member, whether a screen abrasive, a perforated coated abrasive, or otherwise, may comprise openings having different open areas. The "open area" of an opening in the porous abrasive member refers to the area of the opening as measured over the thickness of the porous abrasive member (i.e., the area bounded by the perimeter of material forming the opening through which a three-dimensional object could pass). Useful porous abrasive members typically have an average open area of at least about 0.5 square millimeters per opening. In some embodiments, the porous abrasive member has an average open area of at least about one square millimeter per opening. In yet further embodiments, the porous abrasive member has an average open area of at least about 1.5 square millimeters per opening.

The porous abrasive member, whether woven, perforated or otherwise, comprises a total open area that affects the amount of air that may pass through the porous abrasive member as well as the effective area and performance of the abrasive layer. The "total open area" of the porous abrasive member refers to the cumulative open areas of the openings as measured over the area formed by the perimeter of the porous abrasive member. Porous abrasive members have a total open area of at least about 0.01 square centimeters per square centimeter of the abrasive layer (i.e., 1 percent open area). In some embodiments, the porous abrasive member has a total open area of at least about 0.03 square centimeters per square centimeter of the abrasive layer (i.e., 3 percent open area). In yet further embodiments, the porous abrasive member has a total open area of at least about 0.05 square centimeters per square centimeter of the abrasive layer (i.e., 5 percent open area).

Typically, the porous abrasive member has a total open area that is less than about 0.95 square centimeters per square centimeter of the abrasive layer (i.e., 95 percent open area). In some embodiments, the porous abrasive member has a total open area that is less than about 0.9 square centimeters per square centimeter of the abrasive layer (i.e., 90 percent open area). In yet further embodiments, the porous abrasive member has a total open area that is less than about 0.80 square centimeters per square centimeter of the abrasive layer (i.e., 80 percent open area).

As discussed above, the porous abrasive member, whether a perforated coated abrasive, a coated screen abrasive, a nonwoven abrasive, or otherwise, comprises a plurality of abrasive particles and at least one binder. In some embodiments, the abrasive layer comprises a make coat, a size coat, a supersize coat, or a combination thereof. In some embodiments, the abrasive layer is provided, at least in part, by curing a slurry coat comprising abrasive particles in a binder precursor. Typically, a make layer of a coated abrasive is prepared by coating at least a portion of a substrate (e.g., a treated or untreated backing, open mesh, or nonwoven fiber web) with a make layer precursor comprising a first binder precursor.

The substrate may have one or more treatments (e.g., a backsize, presize, saturant, or subsize) thereon. Suitable substrates are widely known in the abrasive arts and may consist of, for example, metal foil, paper, fabric (e.g., knits, nonwovens, or wovens (including open scrims and tightly woven fabrics), woven mesh (e.g., scrim), plastic film (e.g., including thermoplastic materials such as polyester, polyethylene, and polypropylene), and combinations thereof. In some embodiments, the substrate does not have a laminate structure.

The substrate is preferably relatively thin and flexible. For example, in some embodiments, the substrate may have a thickness of less than 1 millimeter, less than 0.5 millimeter, or even less than 0.1 millimeter. In some embodiments, the perforations, holes, or other porous features extending through the thickness of the substrate have a substantially uniform cross-section throughout their length.

Abrasive particles are then at least partially embedded (e.g., by electrostatic or drop coating) to the make layer precursor comprising a first binder precursor, and the make layer precursor is at least partially cured. Electrostatic coating of the abrasive particles typically provides erectly oriented abrasive particles. In the context of the abrasive articles, the term "erectly oriented" refers to a characteristic in which the longer dimensions of a majority of the abrasive particles are oriented substantially perpendicular (i.e., between 60 and 120 degrees) to the substrate. Other techniques for erectly orienting abrasive particles may also be used.

Next, the size layer is prepared by coating at least a portion of the make layer and abrasive particles with a size layer precursor comprising a second binder precursor (which may be the same as, or different from, the first binder precursor), and at least partially curing the size layer precursor. In some coated abrasive articles, a supersize is applied to at least a portion of the size layer. If present, the supersize layer typically includes grinding aids and/or anti-loading materials.

Typically, a binder is formed by curing (e.g., by thermal means, or by using electromagnetic or particulate radiation) a binder precursor. Useful binder precursors suitable for use in make, size, supersize, and slurry coats are well known in the abrasive art and include, for example, free-radically polymerizable monomer and/or oligomer, epoxy resins, acrylic resins, urethane resins, phenolic resins, urea-formaldehyde resins, melamine-formaldehyde resins, aminoplast resins, cyanate resins, or combinations thereof. Useful binder precursors include thermally curable resins and radiation curable resins, which may be cured, for example, thermally and/or by exposure to radiation.

As is well known in the art, catalysts, initiators, and/or curatives may be used in combination with binder precursors, typically in an effective amount.

Suitable abrasive particles for the coated abrasives include, for example, any known abrasive particles or materials commonly used in abrasive articles. Examples of useful abrasive particles for coated abrasives include, for example, fused aluminum oxide, heat treated aluminum oxide, white fused aluminum oxide, black silicon carbide, green silicon carbide, titanium diboride, boron carbide, tungsten carbide, titanium carbide, diamond, cubic boron nitride, garnet, fused alumina zirconia, sol gel abrasive particles, silica, iron oxide, chromia, ceria, zirconia, titania, silicates, metal carbonates (such as calcium carbonate (e.g., chalk, calcite, marl, travertine, marble and limestone), calcium magnesium carbonate, sodium carbonate, magnesium carbonate), silica (e.g., quartz, glass beads, glass bubbles and glass fibers) silicates (e.g., talc, clays, (montmorillonite) feldspar, mica, calcium silicate, calcium metasilicate, sodium aluminosilicate, sodium silicate) metal sulfates (e.g., calcium sulfate, barium sulfate, sodium sulfate, aluminum sodium sulfate, aluminum sulfate), gypsum, aluminum trihydrate, graphite, metal oxides (e.g., tin oxide, calcium oxide), aluminum oxide, titanium dioxide and metal sulfites (e.g., calcium sulfite), metal particles (e.g., tin, lead, copper), plastic abrasive particles formed from a thermoplastic material (e.g., polycarbonate, polyetherimide, polyester, polyethylene, polysulfone, polystyrene, acrylonitrile-butadiene-styrene block copolymer, polypropylene, acetal polymers, polyvinyl chloride, polyurethanes, nylon), plastic abrasive particles formed from crosslinked polymers (e.g., phenolic resins, aminoplast resins, urethane resins, epoxy resins, melamine-formaldehyde, acrylate resins, acrylated isocyanurate resins, urea-formaldehyde resins, isocyanurate resins, acrylated urethane resins, acrylated epoxy resins), and combinations thereof. The abrasive particles may also be agglomerates or composites that include additional components, such as, for example, a binder. Criteria used in selecting abrasive particles used for a particular abrading application typically include: abrading life, rate of cut, substrate surface finish, grinding efficiency, and product cost.

Coated abrasive members may further comprise optional additives such as abrasive particle surface modification additives, coupling agents, plasticizers, fillers, expanding agents, fibers, antistatic agents, initiators, suspending agents, photosensitizers, lubricants, wetting agents, surfactants, pigments, dyes, UV stabilizers, and suspending agents. The amounts of these materials are selected to provide the properties desired. Additives may also be incorporated into the binder, applied as a separate coating, held within the pores of the agglomerate, or combinations of the above.

If not inherently porous (e.g., due to the nature of the substrate), the abrasive member may be perforated, for example, by mechanical perforation (e.g., die punching), laser perforation, any other suitable technique. Any pattern of perforations may be used. Perforations may be, for example, round or oblong, straight, arcuate, or some complex shape. There should be sufficient porosity of the porous abrasive member to allow particles (e.g., swarf) to flow from the outer abrasive surface to the nonwoven filter medium at a rate comparable to that at which they are generated.

Examples of commercially available apertured coated abrasive articles suitable for use as a porous abrasive member include material available under the trade designation "NORTON MULTI-AIR", from Saint-Gobain Abrasives GmbH, Wesseling, Germany, and coated abrasive discs available under the trade designation "CLEAN SANDING DISC" from 3M Company, Saint Paul. Minn.

In some embodiments, the nonwoven filter medium has an average thickness in a range of at least 0.5, 1, or even at least 5 millimeters up to 10 or 15 millimeters. In other embodiments, the nonwoven filter medium may have a thickness of up to 20, or even 30 millimeters, or more. In some embodiments, the nonwoven filter medium has an average thickness that is less than about 20 millimeters.

In some embodiments, the nonwoven filter medium has a bulk density of from 0.04 to 0.5 grams per cubic centimeter ($g/cm^3$). For example, the filter medium may have a bulk density of from 0.75 to 0.4 $g/cm^3$, or from 1 to 0.3 $g/cm^3$.

The filter medium of the abrasive article may be electrostatically charged. Electrostatic charging enhances the filter medium's ability to remove particulate matter from a fluid stream by increasing the attraction between particles and the surface of the filter medium. Non-impinging particles passing close to fibers of the filter medium are more readily pulled from the fluid stream, and impinging particles are adhered more strongly. Passive electrostatic charging is provided by an electret, which is a dielectric material that exhibits a semi-permanent or permanent electrical charge. Electret chargeable polymeric materials include nonpolar polymers such as polytetrafluoroethylene (PTFE) and polypropylene.

Several methods are used to charge dielectric materials, any of which may be used to charge the filtration medium of the abrasive article, including corona discharge, heating and cooling the material in the presence of a charged field, contact electrification, spraying the web with charged particles, and impinging a surface with water jets or water droplet streams. In addition, the chargeability of the surface may be enhanced by the use of blended materials. Examples of charging methods are disclosed in U.S. Pat. Nos. RE 30,782 (van Turnhout et al.); RE 31,285 (van Turnhout et al.); U.S. Pat. Nos. 5,496,507 (Angadjivand et al.); 5,472,481 (Jones et al.); 4,215,682 (Kubik et al.); 5,057,710 (Nishiura et al.); and U.S. Pat. Nos. 4,592,815 (Nakao); 5,976,208 (Rousseau et al.).

The nonwoven filter medium comprises a plurality of fibers.

In some embodiments, the nonwoven filter medium comprises materials having a fiber size that is less than about 100 microns in diameter, and sometimes less than about 50 microns, and sometimes less than about 1 micron in diameter.

The nonwoven filter medium may be made from a wide variety of organic polymeric materials, including mixtures and blends. Suitable filter medium includes a wide range of materials commercially available. They include polyolefins, such as polypropylene, linear low density polyethylene, poly-1-butene, poly(4-methyl-1-pentene), polytetrafluoroethylene, polychlorotrifluoroethylene; or polyvinyl chloride; aromatic polyarenes, such as polystyrene; polycarbonates;

polyesters; and combinations thereof (including blends or copolymers). In some embodiments, materials include polyolefins free of branched alkyl radicals and copolymers thereof. In yet further embodiments, materials include thermoplastic fiber formers (e.g., polyolefins such as polyethylene, polypropylene, copolymers thereof, etc.). Other suitable materials include: thermoplastic polymers such as polylactic acid (PLA); non-thermoplastic fibers such as cellulose, rayon, acrylic, and modified acrylic (halogen modified acrylic); polyamide or polyimide fibers such as those available under the trade designations "NOMEX" and "KEVLAR" from E.I. du Pont de Nemours & Co., Wilmington, Del.; and fiber blends of different polymers.

The nonwoven filter medium may be formed in a web by conventional nonwoven techniques including, for example, melt blown (e.g., as resulting in blown microfiber webs), spunbond, carding, air laid (dry laid), or wet laid techniques. Details concerning blown microfiber webs and methods for their manufacture are well known in the art and may be found, for example, in U.S. Pat. Nos. 6,139,308 (Berrigan et al.) and 5,496,507 (Angadjivand et al.). Exemplary melt blown nonwoven filter media include bimodal blown microfiber media, for example, as described in U.S. patent application Ser. No. 11/461,136 to Brandner et al., filed Jul. 31, 2006.

If desired, the nonwoven filter medium may have a gradient density, for example, as prepared by contacting a thermoformable nonwoven web with a hot can.

If desired, the fibers or webs may be charged by known methods, including, for example, by use of corona discharge electrodes or high-intensity electric fields. The fibers may be charged during fiber formation, prior to or while forming the fibers into the filter web or subsequent to forming the filter web. The nonwoven filter medium may comprise fibers coated with a polymer binder or adhesive, including pressure sensitive adhesives.

The porous attachment fabric allows air to pass through. The porous attachment fabric may comprise a layer of adhesive, a fabric, a sheet material, a molded body, or a combination thereof. The sheet material may comprise, for example, a loop portion or a hook portion of a two-part mechanical engagement system. The porous attachment fabric may comprise a layer of pressure sensitive adhesive with an optional release liner to protect it during handling.

In some embodiments, the porous attachment fabric comprises a woven or knitted loop material. The loop material may be used to affix the abrasive article to a back-up pad having a complementary mating component. Woven and knit porous attachment fabric materials may have loop-forming filaments or yarns included in their fabric structure to form upstanding loops for engaging hooks. The woven or knitted materials used may be made from natural fibers (e.g., wood or cotton fibers), synthetic fibers (e.g., polyester or polypropylene fibers) or combinations of natural and synthetic fibers. In some embodiments, the porous attachment fabric comprises nylon, polyester, or polypropylene fibers.

In some embodiments, a loop porous attachment fabric has an open structure that does not significantly interfere with the flow of air through it is selected. In some embodiments, the porous attachment fabric material is selected, at least in part, based on the porosity of the material.

In some embodiments, the porous attachment fabric comprises a hook material. The material used to form the hook material useful in the abrasive article may be made in one of many different ways known to those skilled in the art. Several suitable processes for making hook material useful in making porous attachment fabrics include, for example, methods described in U.S. Pat. Nos. 5,058,247 (Thomas et al.); 4,894,060 (Nestegard); 5,679,302 (Miller et al.); and 6,579,161 (Chesley et al.).

The hook material may be a porous material such as, for example the polymer netting material reported in U.S. Pat. Appln. Publ. No. 2004/0170801 (Seth et al.). In other embodiments, the hook material may be apertured to allow air to pass through. Apertures may be formed in the hook material using any methods known to those skilled in the art. For example, the apertures may be cut from a sheet of hook material using, for example, a die, laser, or other perforating instruments known to those skilled in the art. In other embodiments, the hook material may be formed with apertures.

The porous abrasive member and the filter medium of the abrasive article are affixed to one another in a manner that does not prevent the flow of particles from one layer to the next, although some partial or minor obstruction(s) to particle flow may be present. In some embodiments, the porous abrasive member and the filter medium are affixed to one another in a manner that does not substantially inhibit the flow of particles from one layer to the next. In some embodiments, the level of particle flow through the abrasive article may be restricted, at least in part, by the introduction of an adhesive between the porous abrasive member and the nonwoven filter medium. The level of restriction may be minimized by applying the adhesive between layers in a discontinuous fashion such as for example, as discrete adhesive areas (e.g., atomized spray or starved extrusion die) or distinct adhesive lines (e.g., hot melt swirl-spray or patterned roll coater).

The porous attachment fabric of the abrasive article is affixed to the filter medium in a manner that does not prevent the flow of air from the filter medium. In some embodiments, the porous attachment fabric of the abrasive article is affixed to the filter medium in a manner that does not substantially inhibit the flow of air from the filter medium. The level of air flow through the porous attachment fabric may be restricted, at least in part, by the introduction of an adhesive between a porous attachment fabric comprising a sheet material and the filter medium. The level of restriction may be minimized by applying the adhesive between the sheet material of the porous attachment fabric and the filter medium in a discontinuous fashion such as, for example, discrete adhesive areas (e.g., atomized spray or starved extrusion die) or distinct adhesive lines (e.g., hot melt swirl-spray or patterned roll coater).

Exemplary useful adhesives include both pressure sensitive and non-pressure sensitive adhesives. Pressure sensitive adhesives are normally tacky at room temperature and may be adhered to a surface by application of, at most, light finger pressure, while non-pressure sensitive adhesives include solvent, heat, or radiation activated adhesive systems. Examples of useful adhesives include those based on general compositions of polyacrylate; polyvinyl ether; diene-containing rubbers such as natural rubber, polyisoprene, and polyisobutylene; polychloroprene; butyl rubber; butadiene-acrylonitrile polymers; thermoplastic elastomers; block copolymers such as styrene-isoprene and styrene-isoprene-styrene block copolymers, ethylene-propylene-diene polymers, and styrene-butadiene polymers; poly(alpha olefins); amorphous polyolefins; silicone; ethylene-containing copolymers such as poly(ethylene-co-vinyl acetate), poly(ethylene-co-ethyl acrylate), and poly(ethylene-co-ethyl methacrylate); polyurethanes; polyamides; polyesters; epoxies; poly(vinylpyrrolidone) and vinylpyrrolidone copolymers; and mixtures of the above. Additionally, the adhesives may contain additives such as tackifiers, plasticizers, fillers, antioxidants, stabilizers, pigments, diffusing particles, curatives, and solvents.

The various layers in the abrasive article may be held together using any suitable form of attachment such as, for example, glue, pressure sensitive adhesive, hot-melt adhesive, spray adhesive, thermal bonding, needletacking, stitch bonding, and ultrasonic bonding. In some embodiments, the layers are adhered to one another by applying a spray adhesive such as, for example, "3M BRAND SUPER 77 ADHESIVE", available from 3M Company, St. Paul, Minn., to one side of the porous abrasive. In other embodiments, a hot-melt adhesive is applied to one side of a layer using either a hot-melt spray gun or an extruder with a comb-type shim. In yet further embodiments, a preformed adhesive mesh is placed between the layers to be joined.

If desired, a seal may be applied to the peripheral edge of the abrasive article, typically to at least a majority (if not all) of the peripheral edge, to reduce or prevent lateral escape of particles not retained by the abrasive article. Examples of seals include welds, tape, latex coatings, caulks, and sealants (e.g., latex or silicone).

Abrasive articles according to the present invention are generally useful for collecting particles during abrading processes, and in some cases, are capable of retaining large amounts of particles at high rates of delivery. The abrasive articles are suitable for use with any devices adapted for use with such articles. Examples include random orbital, dual action, and disc sanders, with or without vacuum applied to the porous attachment fabric of the abrasive article.

Accordingly, in some embodiments, at least a portion of an abrasive article (e.g., representative of the perforated area) according to the present invention (in an unused state) exhibits a pressure drop according to the Pressure Drop Measurement Test (hereinbelow) in a range of from 0.2 to 20 millimeters of water. For example, at least a portion of an abrasive article according to the present invention (in an unused state) may exhibits a pressure drop according to the Pressure Drop Measurement Test in a range of from 1 to 15 millimeters of water, or even 4 to 10 millimeters of water.

The Pressure Drop Measurement Test is performed as follows:

Pressure drop across the thickness of an abrasive article is determined using a filter testing apparatus comprising a pair of equal inside diameter cylinders mounted in series, such that, the length of the cylinders is in the vertical direction, and such that air flows through the cylinders with a face velocity of 5.2 centimeters per second. A pressure transducer is mounted to each cylinder to measure the pressure within the cylinders. The adjacent ends of the top and bottom cylinders are sealed upon the abrasive article. The abrasive article being tested is tightly clamped, so as to prevent sideways leakage, between the cylinders with the outer abrasive surface of the abrasive article being perpendicular to the direction of, and facing, the air flow. The difference in air pressure between the first and second cylinders is recorded as the pressure drop of the abrasive article.

All patents, patent applications, and publications cited herein are each incorporated by reference in their entirety, as if individually incorporated.

Advantages and other embodiments of this invention are further illustrated by the following examples, but the particular materials and amounts thereof recited in these examples, as well as other conditions and details, should not be construed to unduly limit this invention.

Unless otherwise indicated, all parts, percentages, ratios, etc. in the Examples and the rest of the specification are by weight.

EXAMPLES

The following abbreviations are used throughout the Examples below:

MATERIALS

| IDENTIFICATION | DESCRIPTION |
|---|---|
| AM1 | A non-porous coated abrasive material, commercially available under the trade designation "360L GRADE P800" from 3M Company; St. Paul, Minnesota. |
| AM2 | AM1 laminated to a 13 mil transfer tape, the layered construction laser cut to 5-inch (12.7-cm) diameter discs having a distribution of laser perforated holes prepared according to Procedure 2 (hereinbelow) |
| AM3 | A 6-inch (15.2-cm) diameter porous coated abrasive material, commerically available under the trade designation "NORTON MULTI-AIR, P800" from Norton, Worcester, Massachusetts, die cut to a 5-inch (12.7-cm) diameter disc. |
| AM4 | A grade P320 porous screen abrasive with an integral loop attachment backing, commercially available under the trade designation "ABRANET P320" from KWH Mirka Ltd., Jeppo, Finland. |
| AM5 | An ANSI Grade 500 porous abrasive article, commercially available under the trade designation "3M 281 FABRICUT" from the 3M Company, die cut into 5-inch (12.7-cm) diameter discs. |
| AM6 | A replicate of the screen abrasive described in Example 3 from U.S. Pat. Appl. Publ. No. 2006/0148390 A1 (Woo et a1.) |
| FM1 | A nonwoven polyester pad, commercially available under the trade designation "3M Carpet Bonnet Pad White" from 3M Company, die cut to a 5-inch (12.7-cm) diameter disc. |
| FM3 | FM1 having the edge sealed with a commercially available caulk, as described in Procedure 1 (hereinbelow). |
| AT1 | A loop attachment fabric, commercially available under the trade designation "70 G/M$^2$ TRICOT DAYTONA BRUSHED NYLON LOOP FABRIC" from Sitip SpA, Gene, Italy. |

Procedure 1: Filter Medium Edge Sealing

The edge of a disc of filter medium 1, FM1, was sealed by applying a smooth, continuous bead of silicon-acrylic caulking material having the trade designation "DAP ALEX PLUS" manufactured by DAP Products, Inc., Baltimore, Md.; around the peripheral edge (abutting the circumference) of the disc. The caulk was forced into the edge of the filter medium via a spatula. The caulk was allowed to dry at least 8 hours. FM1, sealed in this manner was designated as FM3.

Figure 4:
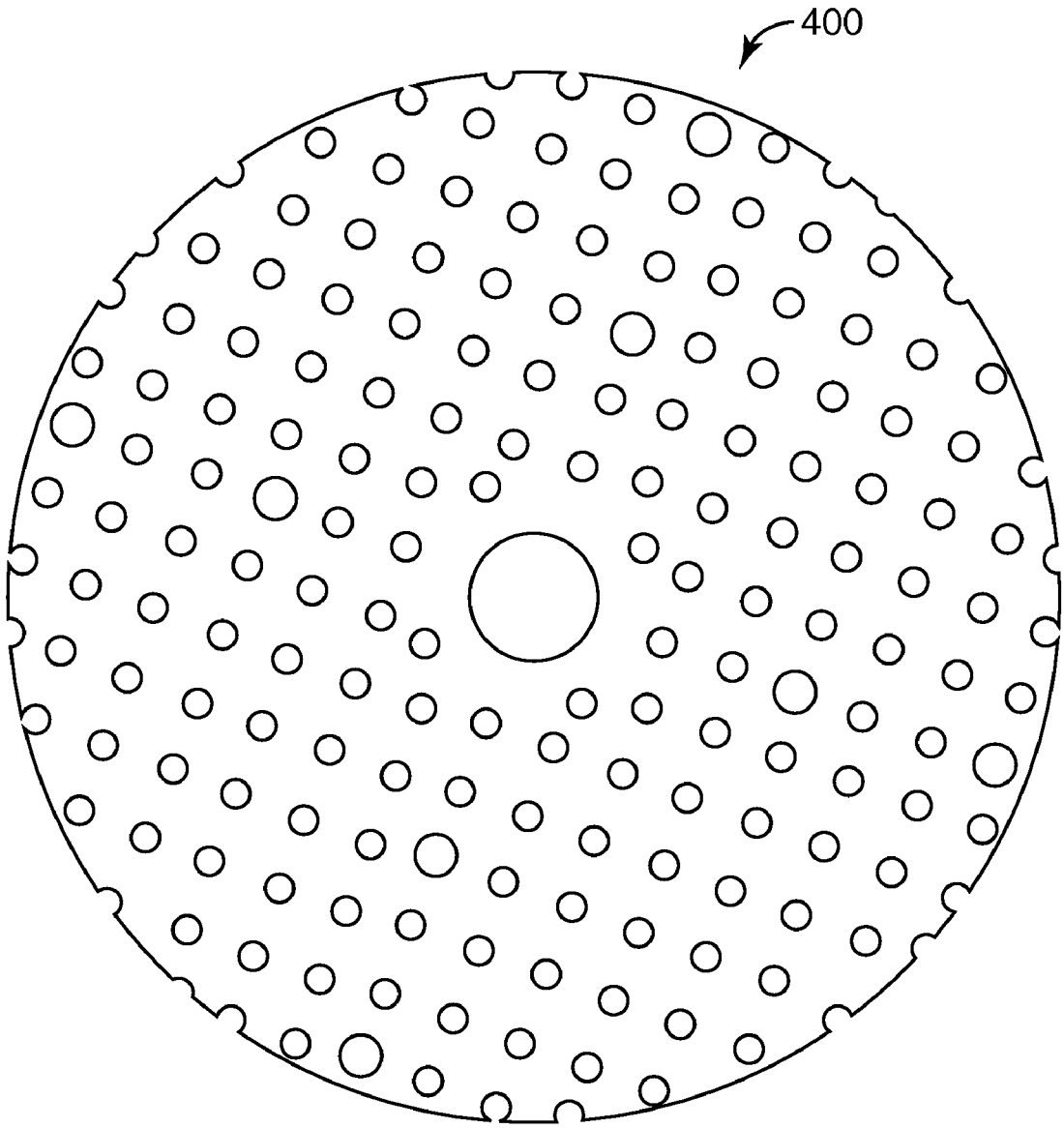
FIG. 4 is a scale top view showing an exemplary perforation pattern 400 for a 5-inch diameter coated abrasive disc.

Procedure 2: Lamination of Transfer Tape to Abrasive Material and Laser Perforation A sheet of abrasive material 1, AM1, was laminated to similar sized sheet of a dual-sided transfer tape having the trade designation "3M 964 13 MIL TRANSFER TAPE" available from the 3M Company, by the following procedure. One side of the tape's liner was removed and the side of a sheet of AM1 opposite the outer abrasive surface was hand-laminated to the exposed, tacky pressure sensitive adhesive of the tape. The laminated abrasive was laser perforated according to pattern 400 shown in FIG. 4. Laser perforated and cut 5-inch diameter discs of this layered construction were designated as AM2.

Procedure 3: Attachment of Filter Medium or Abrasive Material to AT1

A pressure-sensitive adhesive, commercially available under the trade designation "SUPER 77 SPRAY ADHESIVE" from 3M Company, was applied to the non-loop side of an approximately 6-inch (15.2-cm) square sheet of AT1 and allowed to dry for approximately 30 seconds at 25 degrees Celsius. The dry weight of adhesive was about 12 milligrams per square centimeter (mg/cm$^2$). The circular surface of the filter media FM1 or FM3, or abrasive material AM5 or AM6, was laminated to the adhesive coated surface of AT1. The excess material of AT1 protruding from the edge of the construction was removed by cutting with a scissors, creating a circular, substantially coextensive, multi-layer construction.

Procedure 4: Attachment of Filter Medium to AM2

The liner of the transfer tape of AM2 was removed exposing the tacky, pressure sensitive adhesive of the tape. The appropriate circular disc of filter media, FM1 or FM3, was aligned with and hand laminated to the adhesive, such that, the layer of AM2 and the layer of filter medium were substantially coextensive.

Using the procedures described above, a variety of multi-layer abrasive filter discs were prepared as designated in Table 1, Table 2, and Table 3. Replicate examples (i.e., replicates of the same construction) are designated by a numeral followed by a letter (e.g., Example 1a and Example 1b). Replicate comparative examples are designated by a letter followed by a numeral (e.g., Comparative Example A1 and Comparative Example A2). Various properties of some of the media materials are reported in Table 4.

For any given specific example, the components (e.g., abrasive media, filter media, and attachment fabric) that are adjacent to one another in the Tables are adjacent to one another in the actual abrasive articles. It will be apparent to one of skill in the art that the processing sequence in which the layers are combined together to form the multi-layer abrasive disc is often not of particular concern, as long as the desired final construction is obtained.

Test Methods

Sanding Test Method 1

A 5.0-inch (12.7-cm) diameter abrasive disc was weighed and then attached to a 40-hole, 5.0-inch (12.7-cm) diameter by ⅜-inch (0.95-cm) thick foam back up pad, available under the trade designation "3M HOOKIT BACKUP PAD, #20206" from 3M Company. The backup pad and disc assembly was then mounted onto a 5-inch (12.7-cm) diameter, medium finishing, dual-action orbital sander, model 21033, obtained from Dynabrade Corp., Clarence, N.Y. The abrasive face of the disc was manually brought into contact with a pre-weighed, 18 inches by 30 inches (46 cm by 76 cm) gel-coated fiberglass reinforced plastic panel, obtained from White Bear Boat Works, White Bear Lake, Minn. The sander was run at 90 psi (620 kPa) air line pressure and a down force of 10 pounds force (44 N) for 2 cycles of 75 seconds each. An angle of zero degrees to the surface of the workpiece was used. Each cycle consisted of 24 overlapping transverse passes, for a combined 504 inches (12.8 meters) total length, at a tool speed of 6.7 inches per second (17 cm per second) across the panel surface resulting in an evenly sanded area of test panel. After the first sanding cycle, the test panel was cleaned by blowing compressed air across the top of the sanded panel to remove visible dust. The disc was removed from the back up pad and both the panel and disc were weighed. The abrasive was remounted on the back up pad and the 75-second sanding cycle was repeated using the same test panel. The test panel was again cleaned by blowing compressed air across the top of the sanded panel to remove visible dust. The abrasive disc was removed from the back-up pad and both the panel and abrasive disc were weighed. Reported data is after the 2$^{nd}$ sanding cycle, cumulative sanding time of 150 seconds.

The following measurements were made for each sample tested by this method and reported as an average of two test samples per example in Tables 1 and Table 2 as indicated:

"Cut": Weight, in grams, removed from the plastic panel;

"Retain": weight, in grams, of particles collected in the sample disc; and

"DE%": Ratio of the Retain/Cut multiplied by 100.

Surface Finish Measurement Test Method

The resulting surface roughness of the abraded test panels was determined by using a surface finish testing device available under the trade designation "PERTHOMETER MODEL M4P-130589" from Mahr Corporation, Cincinnati, Ohio. Surface finish values were measured at three abraded sections of the test panel after each completed 150-second sanding test. The Rz (also known as Rtm), which is the mean of the maximum peak-to-valley values, was recorded for each measurement.

Modified Pressure Drop Measurement Test

The Pressure Drop Measurement Test given herein above was carried out using a filter testing apparatus comprising a pair of 4.5-inch (11.4-cm) inside diameter cylinders with an air flow rate of 32 liters per minute. Pressure transducers were obtained from MKS Instruments, Wilmington, Mass. under the trade designation "MKS BARATRON PRESSURE TRANSDUCER, 398HD-00010SP12" (10 torr (1.33 kPa) range).

Sanding Test 1 was used as the abrading procedure corresponding to the data generated in Table 1.

Modified Pressure Drop Test measurements were not made on all examples. Modified Pressure Drop Test for certain Examples reported in Table 1 are reported in Table 2 along with data associated with additional comparative examples.

Modified Pressure Drop Test measurements were taken on abrasive articles prior to any abrading conducted via Sanding Test Method 1.

Pressure drop measurements were taken on abrasive articles prior to any abrading conducted via Sanding Test Method 1, with exceptions noted in Table 2.

TABLE 1

| | ABRASIVE MEMBER | NONWOVEN FILTER MEDIUM | ATTACHMENT FABRIC | Cut, g | Retain, g | DE, % | Rz, (micrometers) |
|---|---|---|---|---|---|---|---|
| Example 1a | AM2 | FM1 | AT1 | 2.58 | 2.08 | 81 | 1.2 |
| Example 2 | AM2 | FM3 | AT1 | 2.67 | 1.84 | 69 | 1.4 |
| Comparative Example A1 | AM3 | — | — | 4.22 | 0.08 | 2 | 1.9 |
| Comparative Example G1 | AM2 | FM1 | — | 2.62 | 2.25 | 86 | 1.1 |
| Comparative Example H | AM2 | FM3 | — | 2.47 | 1.88 | 76 | 1.2 |

TABLE 2

| | ABRASIVE MEMBER | NONWOVEN FILTER MEDIUM | ATTACHMENT FABRIC | ΔP (MM $H_2O$) |
|---|---|---|---|---|
| Example 1b | AM2 | FM1 | AT1 | 0.71 |
| Comparative Example G2 | AM2 | FM1 | none | 0.38 |
| Comparative Example A2 | AM3 | none | none | 0.06 |
| Comparative Example B | AM4 | none | none | 0.03 |
| Comparative Example C | AM5 | none | none | 0.03 |
| Comparative Example D | AM5 | none | AT1 | 0.09 |
| Comparative Example E | AM6 | none | none | 0.03 |
| Comparative Example F | AM6 | none | AT1 | 0.10 |

TABLE 3

| MEDIUM | BASIS WEIGHT ($g/m^2$) | CALIPER (cm) | BULK DENSITY ($g/cm^3$) | FIBER DIAMETER (micrometers) |
|---|---|---|---|---|
| FM1 | 482 (461-503) | 0.706 (0.67-0.74) | 0.068 | 30 |
| AT1 | 70 | 0.045 | 0.156 | not determined |

Various modifications and alterations of this invention may be made by those skilled in the art without departing from the scope and spirit of this invention, and it should be understood that this invention is not to be unduly limited to the illustrative embodiments set forth herein.

What is claimed is:

1. An abrasive article comprising:

a porous abrasive member comprising: an abrasive layer proximate and affixed to a first surface of a substrate, the abrasive layer comprising a plurality of abrasive particles affixed to the first surface of the substrate by at least one binder, wherein the abrasive layer has an outer abrasive surface, wherein the substrate has a thickness and a second surface opposite the first surface of the substrate, wherein a plurality of openings extend from the outer abrasive surface to the second surface of the substrate, and wherein the porous abrasive member has perforations that extend through the thickness of the substrate and have a substantially uniform cross-section throughout their length;

a unitary nonwoven filter medium having a first surface and a second surface opposite the first surface, wherein the first surface of the nonwoven filter medium is proximate and affixed to the second surface of the substrate, and wherein the nonwoven filter medium comprises a plurality of synthetic fibers selected from the group consisting of polypropylene fibers, polyester fibers, nylon fibers, and mixtures thereof, and wherein the first surface of the nonwoven filter medium and the second surface of the substrate are held together by a pressure sensitive adhesive that contacts the first surface of the nonwoven filter medium and the second surface of the substrate; and a porous attachment fabric proximate and affixed to the second surface of the nonwoven filter medium, wherein the porous attachment fabric comprises a woven or knitted loop material having loop-forming filaments or yarns included in the fabric structure to form upstanding loops for engaging hooks, and wherein the second surface of the nonwoven filter medium and the porous attachment fabric are held together by a pressure sensitive adhesive that contacts the second surface of the nonwoven filter medium and the porous attachment fabric;

wherein the plurality of openings cooperate with the nonwoven filter medium to allow the flow of particles from the outer abrasive surface to the porous attachment fabric, and wherein, in an unused state, die at least a portion of the abrasive article exhibits a pressure drop according to the Pressure Drop Measurement Test in a range of from 0.2 to 20 millimeters of water.

2. An abrasive article according to claim 1, wherein the porous abrasive member comprises an apertured coated abrasive.

3. An abrasive article according to claim 1, wherein the nonwoven filter medium has a peripheral edge, and wherein the peripheral edge is sealed.

4. An abrasive article according to claim 1, wherein the nonwoven filter medium comprises a blown microfiber web.

5. An abrasive article according to claim 1, wherein the nonwoven filter medium comprises an electret charge.

6. An abrasive article according to claim 1, wherein the substrate is selected from the group consisting of metal foil, paper, fabric, and plastic film.

7. An abrasive article according to claim 1, wherein the abrasive article comprises an abrasive disc.

8. An abrasive article comprising:

a porous abrasive member comprising: an abrasive layer proximate and affixed to a first surface of a substrate, the abrasive layer comprising a plurality of abrasive particles affixed to the first surface of the substrate by at least one binder, wherein the abrasive layer has an outer abrasive surface, wherein the substrate has a thickness and a second surface opposite the first surface of the substrate, wherein a plurality of openings extend from the outer abrasive surface to the second surface of the substrate, and wherein the porous abrasive member has perforations that extend through the thickness of the substrate and have a substantially uniform cross-section throughout their length;

a unitary nonwoven filter medium having a first surface and a second surface opposite the first surface, wherein the first surface of the nonwoven filter medium is proximate and affixed to the second surface of the substrate, wherein the nonwoven tutor medium comprises a plurality of synthetic fibers selected from the group consisting of polypropylene fibers, polyester fibers, nylon fibers, and mixtures thereof, and wherein the nonwoven filter medium has a thickness of from 1 to 25 millimeters and a bulk density of from 0.04 to 0.5 grams per cubic centimeter, and wherein the first surface of the nonwoven filter medium and the second surface of the substrate are held together by a pressure sensitive adhesive that contacts the first surface of the nonwoven filter medium and the second surface of the substrate; and a porous attachment fabric proximate and affixed to the second surface of the nonwoven filter medium, wherein the porous attachment fabric comprises a woven or knitted loop material having loop-forming filaments or yarns included in the fabric structure to form upstanding loops for engaging hooks, and wherein the second surface of the nonwoven filter medium and the porous attachment fabric are held together by a pressure sensitive adhesive that contacts the second surface of the nonwoven filter medium and the porous attachment fabric;

wherein the plurality of openings cooperate with the nonwoven filter medium to allow the flow of particles from the outer abrasive surface to the porous attachment fabric.

9. An abrasive article according to claim 8, wherein the nonwoven filter medium and the porous attachment fabric are affixed to one another by needletacking or a stitch bond.

10. An abrasive article according to claim 8, wherein the nonwoven filter medium has a peripheral edge, and wherein the peripheral edge of the nonwoven filter medium is sealed.

11. An abrasive article according to claim 8, wherein the nonwoven filter medium comprises a blown microfiber web.

12. An abrasive article according to claim 8, wherein the nonwoven filter medium comprises an electret charge.

13. An abrasive article according to claim 8, wherein the substrate is selected from the group consisting of metal foil, paper, fabric, and plastic film.

14. An abrasive article according to claim 8, wherein the abrasive article comprises an abrasive disc.

* * * * *

UNITED STATES PATENT AND TRADEMARK OFFICE

CERTIFICATE OF CORRECTION

PATENT NO. : 7,628,829 B2
APPLICATION NO. : 11/688482
DATED : December 8, 2009
INVENTOR(S) : Edward J. Woo It is certified that error appears in the above-identified patent and that said Letters Patent is hereby corrected as shown below:

Column 16

Line 50; Claim 1, delete "die" and insert -- the --, therefor.

Column 17

Line 22; Claim 8, delete "tutor" and insert -- filter --, therefor.

Signed and Sealed this

Sixteenth Day of February, 2010

David J. Kappos

David J. Kappos
*Director of the United States Patent and Trademark Office*